US005653211A

United States Patent [19]

Ishikawa

[11] Patent Number: 5,653,211

[45] Date of Patent: Aug. 5, 1997

[54] CANISTER

[75] Inventor: Takashi Ishikawa, Okazaki, Japan

[73] Assignee: Toyota Jidosha Kabushiki Kaisha, Toyota, Japan

[21] Appl. No.: 583,298

[22] Filed: Jan. 5, 1996

[30] Foreign Application Priority Data

Jan. 10, 1995 [JP] Japan ..... 7-002122

[51] Int. Cl.[6] ..... F02M 37/04

[52] U.S. Cl. ..... 123/520; 123/198 D

[58] Field of Search ..... 123/520, 521, 123/198 D, 518, 516; 55/387

[56] References Cited

U.S. PATENT DOCUMENTS

| | | | |
|---|---|---|---|
| 4,338,106 | 7/1982 | Mizuno | 123/519 |
| 4,714,172 | 12/1987 | Morris | 220/86 |
| 4,714,485 | 12/1987 | Covert | 123/519 |
| 5,275,144 | 1/1994 | Gross | 123/520 |
| 5,408,976 | 4/1995 | Reddy | 123/519 |

FOREIGN PATENT DOCUMENTS

| | | |
|---|---|---|
| 4-347357A | 12/1992 | Japan . |
| 5-33734A | 2/1993 | Japan . |
| 5-24939U | 4/1993 | Japan . |

*Primary Examiner*—Carl S. Miller
*Attorney, Agent, or Firm*—Kenyon & Kenyon

[57] ABSTRACT

A canister 12 is provided with a first and second charcoal chambers 22, 23 which are separated from each other by a partition wall 21. An adsorbing material layer 26 is formed in each of the charcoal chambers 22, 23 and the adsorbing material layer 26 is filled with activated carbon particles 25. Fuel vapor introducing ports 29, 32 are formed above the first charcoal chamber 22 so as to introduce fuel vapor, which is generated in a fuel tank 11. An air vent port 33 is formed above the second charcoal chamber 23 so as to discharge fuel vapor (air) from which the fuel component thereof has been collected by the adsorbing material layer 26. Also, a diffusion chamber 28 is formed to connect the first and second charcoal chambers 22, 23. Slanted portions 42, 43 are formed at opposite ends of the diffusion chamber 28 to reduce the flow resistance of the fuel vapor.

14 Claims, 4 Drawing Sheets

CANISTER

BACKGROUND OF THE INVENTION

1. Field of the Invention

The present invention relates generally to a canister which collects fuel vapor generated in a fuel tank of a vehicle, thereby preventing the fuel vapor from leaking to the atmosphere.

2. Description of the Related Art

Conventionally, canisters have been used to prevent a fuel component contained in fuel vapor generated in vehicle fuel tanks from leaking to the atmosphere.

For example, Japanese Unexamined Patent Publication No. Hei 5-33734 discloses a technique to treat fuel vapor by using a canister more efficiently. In this technique, the interior of a canister is divided by a vertically extended partition into two chambers having different volumes. Both chambers accommodate an adsorbing material to adsorb the fuel component of fuel vapor. The chamber having a larger volume serves as a main chamber, while the chamber having a smaller volume serves as a sub chamber. The main chamber communicates with a fuel tank via a fuel vapor passage and also with the intake system of an engine via a purge pipe. The sub chamber is provided with an air introducing port for introducing air into the canister when purge control is performed. The main and sub chambers communicate with each other through a communication passage formed under the chambers. The partition forms a throttle in the communication passage at the boundary between the main chamber and the sub chamber to decrease the cross section of the communication passage.

Fuel vapor generated in the fuel tank is first led to the main chamber of the canister via the fuel vapor passage, so that the fuel component of the fuel vapor is collected by the adsorbing material in the main chamber. After passing through the main chamber, the fuel vapor is led to the sub chamber via the communication passage provided under the main chamber. The remaining fuel component of the fuel vapor which has not been collected by the adsorbing material in the main chamber is collected by the adsorbing material in the sub chamber.

When the fuel vapor flows from the main chamber to the sub chamber through the communication passage, the fuel vapor flows along a generally U-shaped path. This prolongs the period of time during which the fuel vapor contacts the adsorbing material, thereby increasing efficiency in collecting the fuel component. When the fuel vapor flows from the main chamber to the sub chamber, the fuel vapor encounters passage resistance due to the throttle of the communication passage, so that the flow of the fuel vapor is restricted.

Accordingly, the amount of the fuel component that is to be adsorbed by the adsorbing material in the sub chamber decreases, and the adsorbing material in the sub chamber an therefore adsorb the fuel component while reserving some adsorbing capacity. As a result, the fuel vapor introduced to the sub chamber is released to the atmosphere after the fuel component has been sufficiently adsorbed by the adsorbing material. As described above, in the prior art technique, the ability of the canister to treat fuel vapor is increased by providing a throttle in the communication passage through which the fuel vapor passes.

Recently, fuel vapor leaking from fuel tanks through the fuel filling opening to the atmosphere during the filling process is considered to be a significant cause of air pollution.

U.S. Pat. No. 4,714,172 discloses a technique to solve the above-described problem. In this technique, a canister and a fuel tank are connected with each other through a breather passage. Also, a differential pressure valve is disposed in the middle of the breather passage. The differential pressure valve opens when the tank is being filled with fuel. A seal is further provided inside a fuel filling tube. Therefore, when a fill nozzle is inserted into the fuel filling tube, the periphery of the fill nozzle is sealed with respect to the tube.

When the tank is filled with fuel, the internal pressure of the fuel tank increases so that the differential pressure valve opens. Accordingly, fuel vapor flows in the breather passage from the fuel tank to the canister. The fuel component of the fuel vapor is collected by the adsorbing material in the canister. At this time, the periphery of the fill nozzle is sealed by the seal of the fuel filling tube, so that the fuel vapor in the fuel tank is prevented from leaking outside through the fuel filling opening. When this technique is used, it is possible to fill the fuel tank with fuel without allowing fuel vapor to leak from the fuel tank to the outside.

The process of leading fuel vapor, which is generated in a fuel tank upon filling, to a canister in order to collect the fuel component of the fuel vapor is hereinafter referred to as an ORVR (Onboard Refueling Vapor Recovery) treatment.

The amount of fuel vapor that flows into the canister during ORVR treatment (about 45 liters/min) is relatively large compared with the amount of fuel vapor which flows into the canister when the tank is not being filled with fuel (about 1 liter/min). Also, the flow rate of fuel vapor within the canister increases during ORVR treatment. Accordingly, if ORVR treatment is performed using a conventional canister, the following problems occur:

(1) Since the flow resistance of the passage is large in conventional canisters, it is impossible to introduce a large amount of fuel vapor from the fuel tank into the canister during ORVR treatment. Accordingly, the flow of fuel vapor from the fuel tank to the canister is hindered, and the internal pressure of the fuel tank increases. As a result, there is the possibility that filling the fuel tank will be difficult.

(2) Since the flow rate of fuel vapor is large, the fuel vapor may flow unevenly when the fuel component of the fuel vapor is recovered by the canister, so that only part of the fuel vapor will contact the adsorbing material. Accordingly, even when the entire canister has enough adsorbing capacity in reserve, the part of the adsorbing material that the fuel vapor contacts in a concentrated manner reaches a limit in adsorbing performance. As a result, it is possible that fuel vapor from which the fuel component has not been sufficiently recovered is released to the outside.

SUMMARY OF THE INVENTION

Accordingly, it is a primary object of the present invention to provide a canister which exhibits a reduced flow resistance when fuel vapor passes therethrough, and which can prevent the fuel vapor from flowing unevenly within the canister, thereby efficiently utilizing an adsorbing material in the canister.

To achieve the foregoing and other objects and in accordance with the purpose of the present invention, a canister is provided. The canister has a casing and a diffusion chamber, wherein said casing includes a first adsorbing chamber and a second adsorbing chamber each filled with adsorbing material for adsorbing a fuel component in a fuel vapor, wherein said diffusion chamber communicates the first adsorbing chamber and the second adsorbing chamber, and wherein said canister removes fuel from the fuel vapor generated in a fuel tank, and then discharges the fuel vapor to the atmosphere. Said casing has a first side wall, a second side wall, a bottom wall, a first straightening Wall which connect the first side wall and the bottom wall, and a second straightening wall which connect the second side wall and the bottom wall. The first straightening wall changes the direction of the fuel vapor flow so that the fuel vapor smoothly flows from the first side wall to the bottom wall. The second straightening wall changes a direction of the fuel vapor flow so that the fuel vapor smoothly flows from the bottom wall to the second side wall. The fuel vapor in the casing flows along the first side wall, the first straightening wall, the bottom wall, the second straightening wall and the second side wall so as to reduce the flow resistance of the fuel vapor in each adsorbing chamber.

BRIEF DESCRIPTION OF THE DRAWINGS

The feature of the present invention that are believed to be novel are set forth with particularity in the appended claims. The invention, together objects and advantages thereof, may best be understood by reference to the following description of the presently preferred embodiment together with the accompanying drawings in which:

DETAILED DESCRIPTION OF THE PREFERRED EMBODIMENT

The preferred embodiment, in which a canister according to the present invention is utilized in a fuel vapor processing system of a vehicle, will now be described with reference to FIG. 1 through FIG. 6.

Figure 1:
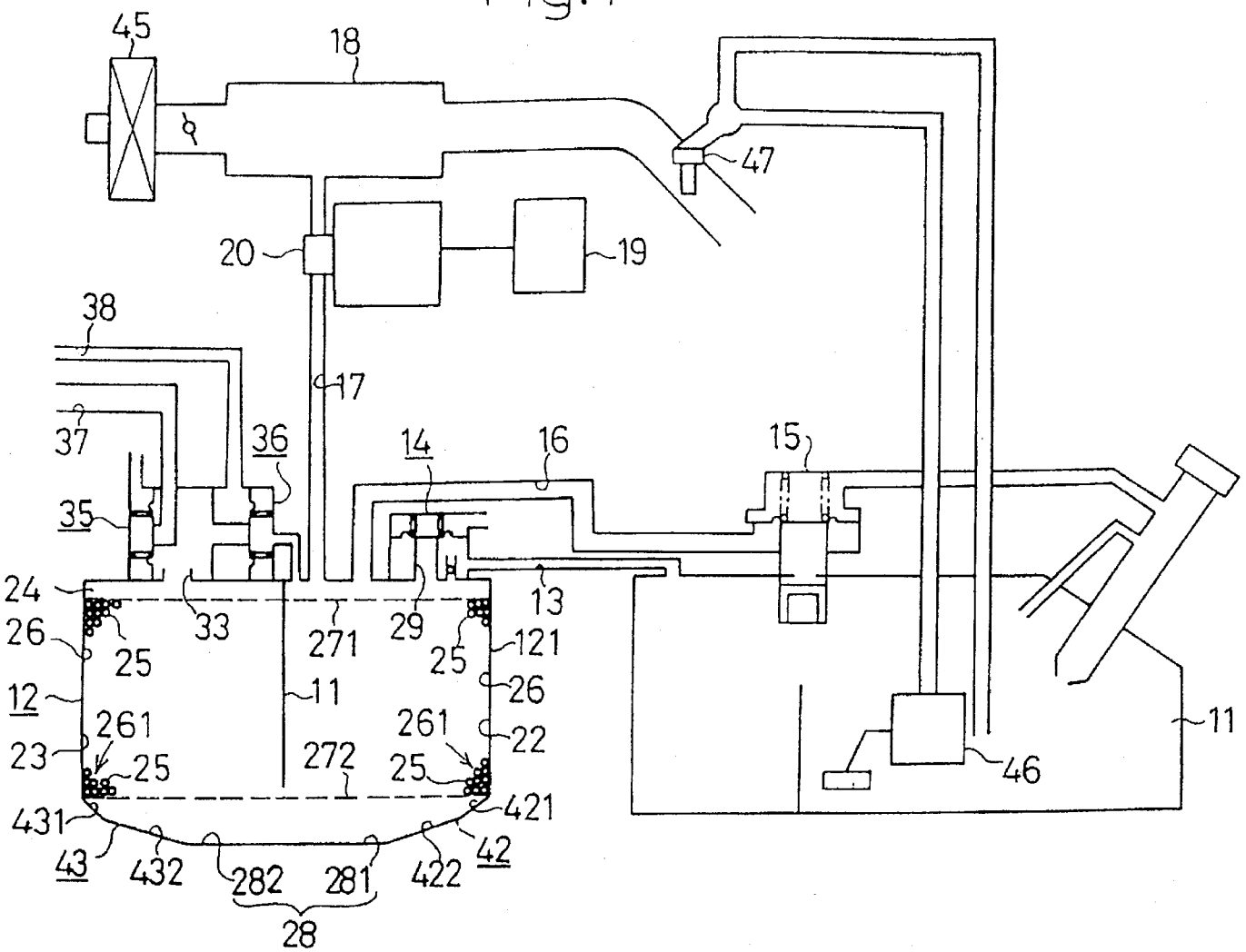
FIG. 1 is a view schematically showing the structure of a fuel vapor treating system which includes a canister according to the present invention.

FIG. 1 is an explanatory chart schematically showing the overall structure of a fuel vapor treating system, which includes a canister 12 according to the present invention. As shown in FIG. 1, one end of a fuel vapor passage 13 is connected to a fuel tank 11 so as to introduce fuel vapor generated in the fuel tank 11 into the canister 12. The other end of the fuel vapor passage 13 is connected to the canister 12 with an internal pressure control valve 14, which is provided on the canister 12 to control the internal pressure of the fuel tank 11. The control valve 14 opens when the internal pressure of the fuel tank 11 exceeds a predetermined value to introduce fuel vapor from the fuel tank 11 into the canister 12.

The fuel tank 11 is also provided with a differential pressure valve 15, which opens when the fuel tank 11 is being filled with fuel. The differential pressure valve 15 is connected to the canister 12 through a breather passage 16. Accordingly, when fuel tank 11 is being filled with fuel, fuel vapor in the fuel tank 11 is introduced into the canister 12 via the breather passage 16. The amount of fuel vapor which passes through the breather passage 16 during ORVR treatment is large compared with the amount of fuel vapor which passes through the fuel vapor passage 13 in an ordinary state. Accordingly, the breather passage 16 has a larger cross section than the fuel vapor passage 13.

The interior of the canister 12 is connected to a surge tank 18, which is part of an engine intake system, by a purge passage 17. A purge amount control valve 20 is disposed in the middle of the purge passage 17. The purge amount control valve 20 receives a control signal sent from an ECU (Electronic Control Unit) 19 so as to control the amount of fuel vapor supplied to the engine intake system.

Figure 2:
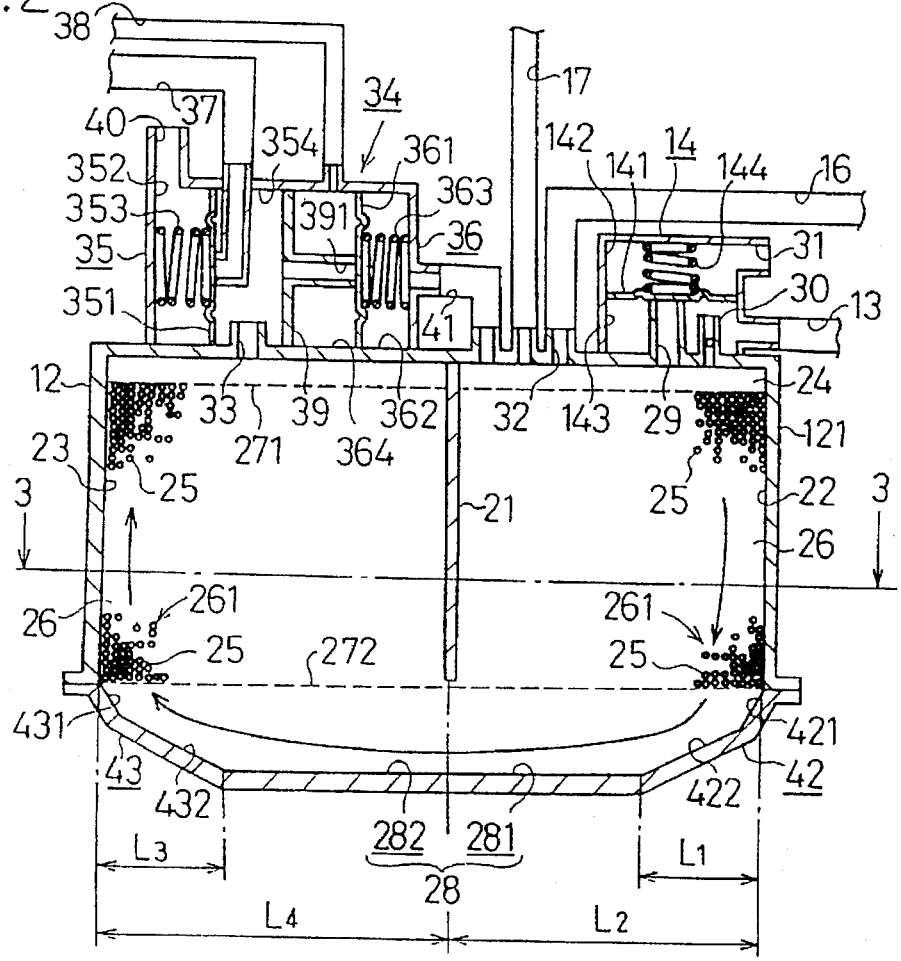
FIG. 2 is a schematic cross-sectional view showing the canister according to the present embodiment and peripheral devices therefor.

FIG. 2 shows the canister 12 used in the present embodiment and peripheral devices therefor. As shown in FIG. 2, a vertically extended partition 21 is located inside a casing 121 of the canister 12. By this partition 21, the interior of the canister 21 is divided into a first charcoal chamber 22 and a second charcoal chamber 23, each serving as an adsorbing material chamber. The first charcoal chamber 22 is located under the internal pressure control valve 14.

An air layer 24 is formed in the upper portion of each of the first and second charcoal chambers 22 and 23 while an adsorbing material layer 26 is formed under the air layer 24. The adsorbing material layer 26 is filled with activated carbon particles 25. A filter 271 and a filter 272 are provided above and below the first and second charcoal chambers 22 and 23, respectively, and the space between the filters 271 and 272 is filled with the activated carbon particles 25.

The space under the filter 272 acts as a diffusion chamber 28. The diffusion chamber 28 includes a first diffusion chamber 281 located under the first charcoal chamber 22 and a second diffusion chamber 282 located under the second charcoal chamber 23. The interior of the first charcoal chamber 22 is connected with the interior of the second charcoal chamber 23 by the diffusion chambers 281 and 282.

A fuel vapor introducing port 29 is formed in the upper wall of the canister 12 at a location above the first charcoal chamber 22 so as to introduce fuel vapor generated in the fuel tank 11 into the interior of the canister 12. A fuel vapor relief valve 30 of a check-ball type is located on the right side of the fuel vapor introducing port 29 as viewed in FIG. 2. This relief valve 30 is adapted to establish communication between the canister 12 and the fuel tank 11 when a negative pressure is produced in the fuel tank 11.

The internal pressure control valve 14 for controlling the internal pressure of the tank 11 is located on the upper wall of the canister 12 so that it covers the fuel vapor introducing port 29. The internal pressure control valve 14 is provided with a diaphragm valve 141. The open upper end of the fuel vapor introducing port 29 is closed by the diaphragm valve 141. Also, the interior of the internal pressure control valve 14 is partitioned by the diaphragm valve 141 to form a back pressure chamber 142 at the upper side and a positive pressure chamber 143 at the lower side of the diaphragm valve 141.

A communication port 31 is formed in the upper portion of the internal pressure control valve 14 located at the back pressure chamber 142 side such that the communication port 31 communicates with the back pressure chamber 142 to maintain the interior of the back pressure chamber 142 at atmospheric air pressure. The interior of the positive pressure chamber 143 communicates with the interior of the fuel tank 11 via the fuel vapor passage 13. The diaphragm valve 141 is pressed against the open upper end of the fuel vapor introducing port 29 by a spring 144 provided in the back pressure chamber 142. Accordingly, the diaphragm valve 141 is maintained at a position for closing the internal pressure control valve 14 until the internal pressure of the fuel tank 11 exceeds a predetermined valve.

Another fuel vapor introducing port 32 is formed in the upper wall of the canister 12 at a location above the first charcoal chamber 22. The fuel vapor introducing port 32 is connected to one end of the breather passage 16. The purge passage 17 is connected to the upper wall of the canister 12 on the left side of the fuel vapor introducing port 32 as viewed in FIG. 2. Like the above-described fuel vapor introducing port 29, the fuel vapor port 32 serves as a fuel vapor introducing port.

An air vent port 33 which serves as the air-side discharging port of the present invention is formed in the upper wall of the canister 12 at a location above the second charcoal chamber 23. An air communication side control valve 34 comprising a discharge control valve, 35 and an air intake control valve 36 are located on both sides of the air vent port 33 while facing each other.

Diaphragm valves 351 and 361 are provided in the discharge control valve 35 and the air intake control valve 36. With this structure, an air pressure chamber 352 is formed on the left side of the diaphragm valve 351 of the discharge control valve 35 while a negative pressure chamber 362 is formed on the right side of the diaphragm valve 361 of the air intake control valve 36. The space between the diaphragm valves 351 and 361 is divided into two pressure chambers by a partition wall 39. One of the pressure chambers is used as a positive pressure chamber 354 for the discharge control valve 35, and the other pressure chamber is used as an air pressure chamber 364 for the air intake control valve 36.

A pressure pipe 391 is formed integrally with the partition wall 39. The open right end of the pressure pipe 391, as viewed in FIG. 2, is closed by the diaphragm valve 361. Since the diaphragm valve 361 is urged toward the open right end of the pressure pipe 391 by a spring 363 located in the negative pressure chamber 362, the air inlet control valve 316 is normally closed. The air intake control valve 36 is opened when the pressure difference between the negative pressure in the negative pressure chamber 362 and the internal pressure of the air pressure chamber 364 reaches a predetermined value due to purge of fuel vapor to the engine intake system.

An air vent port 40 is formed in the upper portion of the air communication side control valve 34 so that the interior of the air pressure chamber 352 is always maintained at atmospheric air pressure. A pressure passage 41 is provided on the right side (as viewed in FIG. 2) of the air communication side control valve 34 to connect the negative pressure chamber 362 with the interior of the first charcoal chamber 22. Therefore, the pressure generated in the purge passage 17 is applied to the negative pressure chamber 362.

The air pressure chamber 364 of the air intake control valve 36 communicates with an air intake passage 38. When fuel vapor in the canister 12 is purged into the surge tank 18, outside air is introduced into the canister 12 via the air intake passage 38.

Also, a discharge passage 37 is connected to the positive pressure chamber 354 of the discharge control valve 35. The discharge passage 37 discharges fuel vapor (air) from which the fuel component thereof has been collected in the canister 12. During ORVR treatment, a large amount of air (fuel vapor from which the fuel component has been collected) is discharged to the outside through the discharge passage 37. Accordingly, the discharge passage 37 has the same cross section as that of the breather passage 16. The upstream end of the discharge passage 37 is closed by the diaphragm valve 351 of the discharge control valve 35. Since the diaphragm valve 351 is urged toward the upstream end of the discharge passage 37 by a spring 353 located in the air pressure chamber 352, the discharge control valve 35 is maintained closed until the internal pressure of the canister 12 exceeds a predetermined value.

Figure 3:
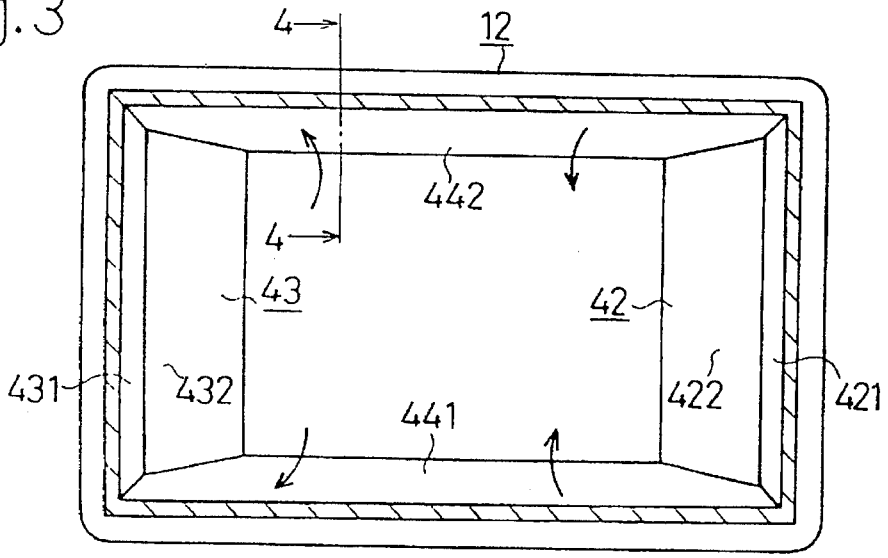
FIG. 3 is a plane cross-sectional view of the canister taken along the line 3—3 in FIG. 2.
Figure 4:
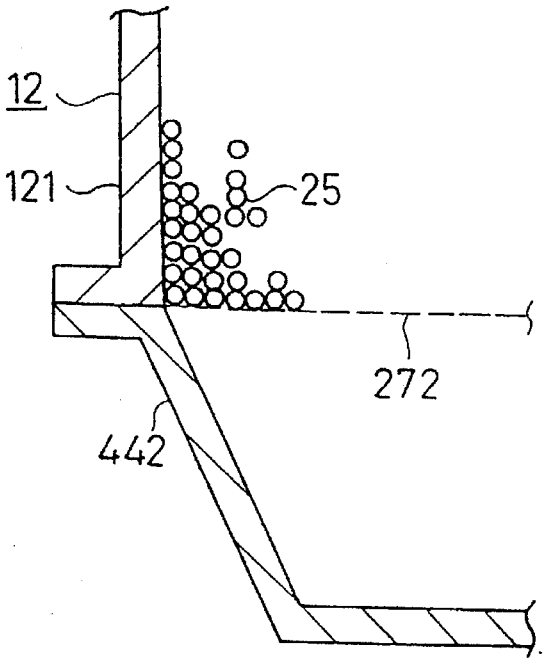
FIG. 4 is a side cross-sectional view of the canister taken along the line 4—4 in FIG. 3.

In the present embodiment, slanted portions 42 and 43 are formed at opposite ends of the bottom portion of the casing 121 so that the slanted portions 42 and 43 are located at the right side of the first diffusion chamber 281 and the left side of the second diffusion chamber 282, respectively, as viewed in FIG. 2. The slanted portions 42 and 43 have a predetermined angle with respect to the central bottom surface of the casing 121. The slanted portions 42 and 43 have two kinds of slanted flat surfaces 421, 422, 431, and 432. The upper-side slanted surfaces 421 and 431 have a slant angle larger than that of the lower-side slanted surfaces 422 and 432. That is, they have a steeper incline. The upper-side slanted surfaces 421 and 431 of the slanted portions 42 and 43 are located under lower corner portions 261 of the adsorbing material layer 26. With this structure, when fuel vapor flows along the surfaces of the slanted portions 42 and 43, the fuel vapor passes through the lower corner portions 261. In addition to the slanted portions 42 and 43 formed at the right and left sides of the diffusion chambers 281 and 282, a slanted portion 442 is formed at the front side (upper side in FIG. 3) of the diffusion chambers 281 and 282, as shown in FIG. 3 FIG. 4. Similarly, a slanted portion 441 is formed at the back side of the diffusion chambers 281 and 282 as seen in FIG. 3.

In the present embodiment, the lengths (indicated by $L_1$ and $L_3$ in FIG. 2) over which the slanted portions 42 and 43 are formed are each one third the entire lengths of the diffusion chambers 281 and 282 (indicated by $L_2$ and $L_4$ in FIG. 2). That is, $L_1=L_2/3$ and $L_3=L_4/3$. The reasons why the lengths $L_1$ and $L_3$ (hereinafter indicated by $L_A$) of the slanted portions 42 and 43 are formed to be one third the entire lengths $L_2$ and $L_4$ (hereinafter indicated by $L_B$) of the diffusion chambers 281 and 282 are as follows.

During ORVR treatment, fuel vapor which is introduced from the fuel tank 11 to the first charcoal chamber 22 through the breather passage 16 passes through the adsorbing material layer 26 and enters the first diffusion chamber 281. The fuel vapor then flows into the second diffusion chamber 282 located on the left side of the first diffusion chamber 281 and enters the adsorbing material layer 26 in the second charcoal chamber 23. Accordingly, the fuel vapor flows along a generally U-shaped flow path in the canister 12, as indicated by arrows in FIG. 2.

That is, the direction of flow of fuel vapor changes after flowing from the first charcoal chamber 22 to the first diffusion chamber 281, and again changes when flowing from the second diffusion chamber 282 to the second charcoal chamber 23. The fuel vapor encounters a large flow resistance every time the direction of the flow changes.

This tendency is particularly remarkable when the flow rate of fuel vapor flowing within the canister 12 is large. For example, during ORVR treatment, the flow resistance is considerably large. To overcome this problem, the slanted portions 42 and 43 are provided at positions where the direction of flow of fuel vapor changes. With the slanted portions 42 and 43, the direction of flow of fuel vapor is gradually changed to lower the flow resistance of the fuel vapor.

Figure 6:
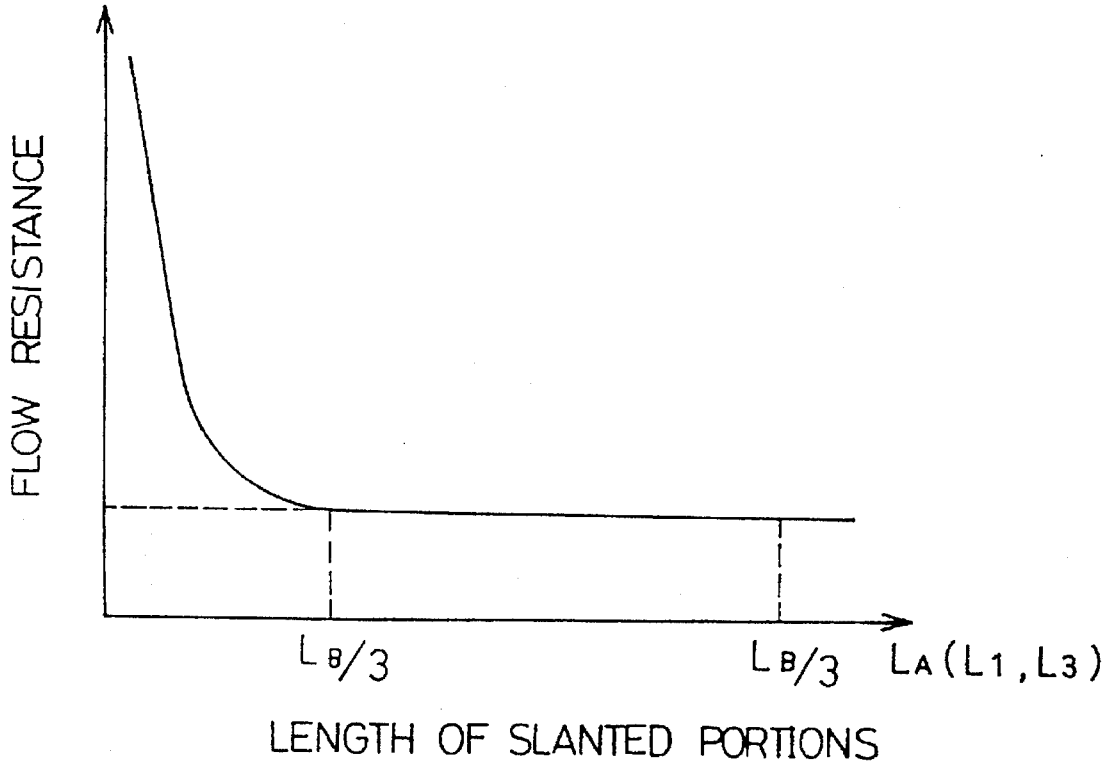
FIG. 6 is a graph showing the relationship between the length of slant portions and the flow resistance of the canister.

FIG. 6 shows the relationship between the length $L_A$ of the slanted portions 42 and 43 of the canister 12 in the present embodiment and the flow resistance of the canister 12. As shown in FIG. 6, the flow resistance of the canister 12 tends to decrease as the length $L_A$ of the slanted portions 42 and 43 increases. When the length $L_A$ of the slanted portions 42 and 43 reaches about one third the entire length $L_B$ of the diffusion chambers 281 and 282, the flow resistance approaches a constant value.

Accordingly, to effectively reduce the flow resistance of the canister 12, it is desired that the length $L_A$ of the slanted portions 42 and 43 be equal to or greater than one third the entire length $L_B$ of the diffusion chambers 281 and 282. In view of the foregoing, the length $L_A$ of the slanted portions 42 and 43 is set to be one third the entire length $L_B$ of the diffusion chambers 281 and 282.

In the present specification, the term "the length of the slanted portions" and the term "the length (entire length) of the diffusion chambers" mean corresponding lengths in the primary direction of flow of fuel vapor in the diffusion chambers. Also, the term "the primary direction" means the general direction of flow of fuel vapor from one of the adsorbing material chambers to the other in which turbulence, and changes in the direction of flow at the slanted portions are not considered.

Next, the operation of the canister 12 of the present embodiment having the above-described structure will be described with reference to FIG. 1 and FIG. 2.

First, a description is given of a process of treating fuel vapor for cases in which ORVR treatment is not performed, i.e., filling of fuel is not performed.

When liquid fuel evaporates in the fuel tank 11 and the internal pressure of the fuel tank 11 exceeds a predetermined level, the internal pressure control valve 14 provided on the canister 12 opens. As a result, fuel vapor flows from the fuel tank 11 into the fuel vapor passage 13 and flows toward the canister 12. After passing through the fuel vapor passage 13, the fuel vapor enters the canister 12 through the fuel vapor introducing port 29. Since the differential pressure valve 15 is closed, the breather passage 16 is closed.

The fuel vapor introduced into the canister 12 reaches the first charcoal chamber 22 after passing through the air layer 24 and the filter 271. The fuel component of the fuel vapor is collected by the activated carbon particles 25 filled in the adsorbing material layer 26. Subsequently, the fuel vapor flows downward so as to enter the first diffusion chamber 281 while passing through the filter 272, and flows from the first diffusion chamber 281 to the second diffusion chamber 282. The fuel vapor further flows from the second diffusion chamber 282 to the second charcoal chamber 23 while passing through the filter 272. The remaining fuel component of the fuel vapor which was not able to be collected in the first charcoal chamber 22 is collected in the adsorbing material layer 26.

Fuel vapor from which the fuel component has been mostly collected by the activated carbon particles 25 in the chambers 22 and 23 is led to the positive pressure chamber 354 of the discharge control valve 35 via the air vent port 33. The fuel vapor causes the discharge control valve 35 to open, so that the fuel vapor is discharged to the outside via the discharge passage 37. At this time, the negative pressure chamber 362 of the air intake control valve 36 has a positive pressure larger than the internal pressure of the air pressure chamber 364. Since the air intake control valve 36 does not open when the internal pressure of the negative pressure chamber 362 is positive, the fuel vapor does not leak to the outside through the air inlet control valve 36.

As described above, the fuel component of fuel vapor is gradually collected while the fuel vapor passes through the adsorbing material layers 26 in the first and second charcoal chambers 22 and 23. Since the flow rate of fuel vapor in the canister 12 is very low, the fuel vapor is uniformly diffused into the adsorbing material layer 216.

Accordingly, the fuel component of fuel vapor is collected by substantially all the activated carbon particles 25 in the adsorbing material layers 26. Also, since fuel vapor flows along a generally U-shaped path within the canister 12, the distance through which the fuel vapor flows is longer, and the period of time in which the fuel vapor contacts the activated carbon particles 25 increases. As a result, the fuel component contained in fuel vapor is efficiently recovered.

When the fuel tank 11 is cooled due to parking the vehicle for a prolonged period of time, the generation of fuel vapor in the fuel tank 11 stops and the internal pressure of the canister 12 becomes higher than that of the fuel tank 11. In such a case, the fuel vapor relief valve 30 opens so that the fuel vapor in the canister 12 is returned to the fuel tank 11 via the fuel vapor passage 13.

Fuel collected in the canister 12 is supplied to the engine intake system as follows.

When the engine (not shown) is started, a negative pressure is produced in the vicinity of the open end of the purge passage 17 adjacent to the surge tank 18, so that the pressure in the purge passage 17 becomes negative. Whenever the purge amount control valve 20 is opened in response to a command from the ECU 19, a flow of fuel vapor from the canister 12 to the surge tank 18 is established in the purge passage 17. Therefore, the internal pressure of the canister 12 becomes negative, and the internal pressure of the negative pressure chamber 362 also becomes negative. As a result, the air intake control valve 36 is opened so that a fresh air is introduced into the canister 12 via the air intake passage 38. The fuel component adsorbed on the activated carbon particles 25 is separated from the activated carbon particles 25 and is absorbed by the fresh air introduced into the canister 12.

The fresh air which has absorbed the fuel component (fuel vapor) is led to the purge passage 17 so that it flows into the surge tank 18 via the purge amount control valve 20. In the surge tank 18, the fuel vapor is mixed with air for combustion which has passed through an air cleaner 45 and is supplied into unillustrated cylinders. The fuel vapor mixed with air is burned together with fuel which is supplied from a fuel pump 46 in the fuel tank and injected from a fuel injection valve 47.

Next, the process of treating fuel vapor during ORVR treatment will be described. The process in which fuel vapor generated in the fuel tank 11 is collected by the activated carbon particles 25 in the canister 12 is substantially the same as that in the previously described process for the case where ORVR treatment is not performed. Here, the operation and effects of the slanted portions 42 and 43 formed in the diffusion chambers 281 and 282 are mainly described.

when fuel is supplied into the fuel tank 11, the level of the fuel increases while a large amount of fuel vapor is generated in the fuel tank 11 so that the internal pressure of the tank 11 increases. The fuel vapor pressurized in the fuel tank 11 causes the differential pressure valve 15 to open. The fuel vapor then flows through the breather passage 16 toward the canister 12 and enters the first charcoal chamber 22 through the fuel vapor introducing port 32. After that, the fuel vapor enters the adsorbing material layer 26 in the first charcoal chamber 22 via the air layer 25.

In the vicinity of the right-side wall of the first charcoal chamber 22, fuel vapor flows downward in the adsorbing material layer 26 and reaches the slanted portion 42 provided at the right side (as viewed in FIG. 2) of the first diffusion chamber 281. After reaching the slanted portion 42, fuel vapor flows along the slanted surfaces 421 and 422.

Therefore, the direction of flow of fuel vapor is gradually changed from the vertical direction in FIG. 2. After flowing along the slanted surfaces 421 and 422, fuel vapor flows leftward in FIG. 2. That is, the direction of fuel vapor flowing in the vicinity of the side wall of the first charcoal chamber 22 is changed by the slanted portion 42 after flowing in the vicinity of the side wall of the first charcoal chamber 22, so that a flow of fuel vapor starting from the charcoal chamber 22 and continuing to the second diffusion chamber 282 via the first diffusion chamber 281 is formed without creating a stagnant region. After the fuel vapor flows from the first diffusion chamber 281 to the second diffusion chamber 282, the direction of flow of fuel vapor is again changed by the slanted portion 43 provided in the second diffusion chamber 282 so that the fuel vapor flows upward in the vicinity of the left-side wall of the second charcoal chamber 23.

As described above, the canister 12 of the present embodiment is provided with slanted portions 42 and 43, so that fuel vapor flows along the side walls of the charcoal chambers 22 and 23, as indicated by solid lines in FIG. 2. Accordingly, the activated carbon particles 25 located in the vicinity of the side walls of the charcoal chambers 22 and 23 are efficiently utilized, unlike conventional canisters in which activated carbon particles located in the vicinity of side walls are efficiently utilized.

Further, in the canister 12, fuel vapor flows in the vicinity of the side walls of the charcoal chambers 22 and 23 so that the cross-sectional area of the flow path through which fuel vapor flows within the canister 12 is substantially increased to reduce the flow resistance. Accordingly, it is possible to treat a large amount of fuel vapor which is generated in the fuel tank 11 during ORVR treatment.

Furthermore, the upper-side slanted surfaces 421 and 431 of the slanted portions 42 and 43 are located under the lower corners 261 of the adsorbing material layers 26. Therefore, fuel vapor flowing along the slanted portion 42 and 43 passes through the lower corners 261. As a result, the pressure is increased in the vicinity of the lower corners 261 due to passage of fuel vapor, so that the activated carbon particles 25 at the lower corners 261 can adsorb an increased amount of fuel vapor.

In addition, since the slanted portions 442 and 441 are formed at the front and back sides of the diffusion chambers 281 and 282, the flow resistance acting on the vertical flow of fuel vapor along the front and back walls of both the first and second charcoal chambers 22, 23 is reduced. Accordingly, the amount of fuel vapor flowing along the front and back walls of both the first and second charcoal chambers 22, 23 increases, so that the activated carbon particles 25 in the vicinity of the front and back walls of both the first and second charcoal chambers 22, 23 are efficiently utilized.

Moreover, since the casing 121 used in the present canister has a shape in which opposite ends of the bottom portion are cut away, mounting space can be more efficiently used.

As described above, the canister 12 has a reduced flow resistance. Especially, since the length $L_A$ of the slanted portions is set to be one third the entire length $L_B$ of the diffusion chambers, the flow resistance is optimally decreased.

In addition, since the activated carbon particles 25 located in the vicinity of the side walls of both the first and second charcoal chambers 22, 23 and at the lower corners 261 are more efficiently utilized, the overall performance of the canister 12 to collect fuel vapor is increased.

Figure 5:
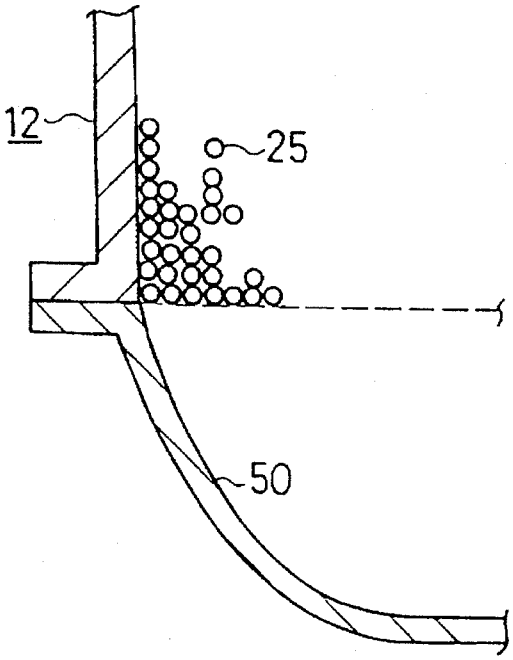
FIG. 5 is a side cross-section view of the canister according to another embodiment.

Although only one embodiment of the present invention has been described, it should be apparent to those skilled in the art that the present invention may be embodied in many other specific forms without departing from the spirit or scope of the invention. Particularly, it should be understood that the present invention may be practiced as follows:

(1) Although the slanted portions 42 and 43 are formed by two kinds of slanted flat surfaces 421, 422, 431 and 432 in the above-described embodiment, the slanted portions 42 and 43 may be formed by curves 50 as viewed in FIG. 5.

Therefore, the present example and embodiment are to be considered as illustrative and not restrictive and the invention is not be limited to the details given herein, but may be modified within the scope of the appended claims.

What is claimed is:

1. A canister having a casing and a diffusion chamber, wherein said casing includes a first adsorbing chamber and a second adsorbing chamber each filled with adsorbing material for adsorbing a fuel component in a fuel vapor, wherein said diffusion chamber communicates the first adsorbing chamber and the second adsorbing chamber, and wherein said canister removes fuel from the fuel vapor generated in a fuel tank, and then discharges the fuel vapor to the atmosphere;

said casing having a first side wall, a second side wall, a bottom wall, a first straightening wall connecting the first side wall and the bottom wall, and a second straightening wall connecting the second side wall and the bottom wall, wherein the first straightening wall changes the direction of the fuel vapor flow so that the fuel vapor smoothly flows from the first side wall to the bottom wall, and wherein the second straightening wall changes a direction of the fuel vapor flow so that the fuel vapor smoothly flows from the bottom wall to the second side wall;

wherein the fuel vapor in the casing flows along the first side wall, the first straightening wall, the bottom wall, the second straightening wall and the second side wall so as to reduce the flow resistance of the fuel vapor in each adsorbing chamber;

wherein said diffusion chamber has a length dimension extending from the first side wall to the second side wall in the primary direction of the fuel vapor flow;

wherein each of said first straightening wall and said second straightening wall has a length dimension extending in the primary direction of the fuel vapor flow; and wherein the sum of the length dimension of the first straightening wall and the length dimension of the second straightening wall is at least one-third of the length dimension of the diffusion chamber.

2. The canister as set forth in claim 1, wherein said first straightening wall and second straightening wall include slanting surfaces which incline by a predetermined angle with respect to the bottom wall.

3. A canister having a casing and a diffusion chamber, wherein the casing includes a first adsorbing chamber and a second adsorbing chamber each filled with adsorbing material for adsorbing a fuel component in a fuel vapor, wherein the diffusion chamber communicates the first adsorbing chamber and the second adsorbing chamber, and wherein the canister removes fuel from the fuel vapor generated in a fuel tank, and then discharges the fuel vapor to the atmosphere, the casing having a first side wall, a second side wall, a bottom wall, a first straightening wall connecting the first side wall and the bottom wall, and a second straightening wall connecting the second side wall and the bottom wall, wherein the first straightening wall and second straightening wall include curved surfaces which have a predetermined radius of curvature, respectively, the first straightening wall changes the direction of the fuel vapor flow so that the fuel vapor smoothly flows from the first side wall to the bottom wall, and wherein the second straightening wall changes a direction of the fuel vapor flow so that the fuel vapor smoothly flows from the bottom wall to the second side wall;

wherein the fuel vapor in the casing flows along the first side wall, the first straightening wall, the bottom wall, the second straightening wall and the second side wall so as to reduce the flow resistance of the fuel vapor in each adsorbing chamber.

4. The canister as set forth in claim 1, wherein the casing has a length dimension extending from the first side wall to the second side wall in the general direction of fuel vapor flow, and wherein each straightening wall extends in the general direction of fuel vapor flow for a distance of at least one sixth of the length dimension.

5. The canister as set forth in claim 2, wherein each said straightening wall comprises a plurality of slanting surfaces each of which has a different angle of inclination with respect to the bottom wall.

6. A canister having a casing and a diffusion chamber, wherein the casing includes a first adsorbing chamber and a second adsorbing chamber each filled with adsorbing material for adsorbing a fuel component in a fuel vapor, wherein the diffusion chamber communicates the first adsorbing chamber and the second adsorbing chamber, and wherein the canister removes fuel from the fuel vapor generated in a fuel tank, and then discharges the fuel vapor to the atmosphere, the casing having a first side wall, a second side wall, a bottom wall, a first straightening wall connecting the first side wall and the bottom wall, and a second straightening wall connecting the second side wall and the bottom wall, the first straightening wall and second straightening wall include a plurality of slanting surfaces which incline by a predetermined angle with respect to the bottom wall and each of which has a different angle of inclination with respect to the bottom wall, the plurality of slanting surfaces having a first slanting surface which is connected with the bottom wall and a second slanting surface which is connected with the first slanting surface and one of side walls, wherein the second slanting surface is more steeply inclined than the first slanting surface, wherein the first straightening wall changes the direction of the fuel vapor flow so that the fuel vapor smoothly flows from the first side wall to the bottom wall, and wherein the second straightening wall changes a direction of the fuel vapor flow so that the fuel vapor smoothly flows from the bottom wall to the second side wall;

wherein the fuel vapor in the casing flows along the first side wall, the first straightening wall, the bottom wall, the second straightening wall and the second side wall so as to reduce the flow resistance of the fuel vapor in each adsorbing chamber.

7. The canister as set forth in claim 4, wherein each of said slanting surfaces comprises a plurality of slanting surfaces which have different angles of inclination.

8. The canister as set forth in claim 6, wherein said casing has a front wall, a back wall, a third slanted surface that is connected with the front wall and the bottom wall, and a fourth slanted surface that is connected with the back wall and the bottom wall, wherein said third and fourth slanted surfaces gradually change the direction of the fuel vapor flow so that the fuel vapor flows with relatively low resistance.

9. The canister as set forth in claim 8, wherein said adsorbing material includes activated carbon.

10. A canister for treating fuel vapor having a casing, a diffusion chamber, an introducing port for introducing the fuel vapor generated in a fuel tank to the a first and a second adsorbing chamber is series and a discharge port for discharging the treated fuel vapor to the atmosphere, wherein the first adsorbing chamber and the second adsorbing chamber are filled with adsorbing material for adsorbing fuel in the fuel vapor, and wherein said diffusion chamber connects the first adsorbing chamber and the second adsorbing chamber, said casing having a first side wall, a second side wall, a bottom wall, a first straightening wall connecting the first side wall and the bottom wall and a second straightening wall connecting the second side wall and the bottom wall, wherein the first straightening wall changes the direction of the fuel vapor flow so that the fuel vapor smoothly flows from the first side wall to the bottom wall, and wherein the second straightening wall changes a direction of the fuel vapor flow so that the fuel vapor smoothly flows from the bottom wall to the second side wall;

and wherein the casing has a length dimension extending from the first side wall to the second side wall in the general direction of fuel vapor flow, and wherein each straightening wall extends in the general direction of fuel vapor flow for vapor flow for a distance of at least one sixth of the length dimension;

and wherein the fuel vapor is introduced to the first adsorbing chamber from the introducing port where it is directed to flow to the diffusion chamber along the first side wall to the first straightening wall and, then to along the bottom wall to the second straightening wall surface and to the second side wall, and then it is discharged to the atmosphere from the discharging port.

11. The canister as set forth in claim 10, wherein each of said straightening walls surfaces comprises a plurality of slanting surfaces which have different angles of inclination.

12. A canister for treating fuel vapor having a casing, a diffusion chamber, an introducing port for introducing the fuel vapor generated in a fuel tank to the a first and a second adsorbing chamber is series and a discharge port for discharging the treated fuel vapor to the atmosphere, wherein the first adsorbing chamber and the second adsorbing chamber are filled with adsorbing material for adsorbing a fuel in the fuel vapor, and wherein the diffusion chamber connects the first adsorbing chamber and the second adsorbing chamber, the casing having a first side wall, a second side wall, a bottom wall, a first straightening wall connecting the first side wall and the bottom wall and a second straightening wall connecting the second side wall and the bottom wall, each of the straightening walls surfaces comprising a plurality of slanting surfaces which have different angles of inclination, and each of the plurality of slanting surfaces has a first slanting surface which is connected with the bottom wall and a second slanting surface which is connected with the first slanting surface and each side wall, and wherein the second slanting surface is more steeply inclined than the first slanting surface; wherein the first straightening wall changes the direction of the fuel vapor flow so that the fuel vapor smoothly flows from the first side wall to the bottom wall, and wherein the second straightening wall changes a direction of the fuel vapor flow so that the fuel vapor smoothly flows from the bottom wall to the second side wall;

and wherein the casing has a length dimension extending from the first side wall to the second side wall in the general direction of fuel vapor flow, and wherein each straightening wall extends in the general direction of fuel vapor flow for a distance of at least one sixth of the length dimension;

and wherein the fuel vapor is introduced to the first adsorbing chamber from the introducing port where it is directed to flow to the diffusion chamber along the first side wall to the first straightening wall and, then to along the bottom wall to the second straightening wall surface and to the second side wall, and then it is discharged to the atmosphere from the discharging port.

13. The canister as set forth in claim 12, wherein said casing has a front wall, a back wall, a third slanted surface that is connected with the front wall and the bottom wall, and a fourth slanted surface that is connected with the back wall and the bottom wall, said third and fourth slanted surfaces gradually change the direction of the fuel vapor flow so that the fuel vapor flows with relatively low resistance.

14. The canister as set forth in claim 13, wherein said adsorbing material includes activated carbon.

* * * * *

UNITED STATES PATENT AND TRADEMARK OFFICE

CERTIFICATE OF CORRECTION

PATENT NO. : 5,653,211

DATED : 5 August 1997

INVENTOR(S) : Takashi ISHIKAWA

It is certified that error appears in the above-identified patent and that said Letters Patent is hereby corrected as shown below:

| Column | Line | |
|---|---|---|
| 1 | 55 | Change "an" to --can--. |
| 3 | 3 | Change "Wall" to --wall--. |
| 8 | 58 | Change "when" to --When--. |

Signed and Sealed this

Twenty-fourth Day of February, 1998

*Attest:*

Bruce Lehman

BRUCE LEHMAN

*Attesting Officer*

*Commissioner of Patents and Trademarks*